United States Patent [19]

Carpenter et al.

[11] Patent Number: 5,060,492

[45] Date of Patent: Oct. 29, 1991

[54] LUGGAGE LATCH

[75] Inventors: Lester E. Carpenter, Middletown; John V. Pulichino, Jr., Providence; David Bieber, East Greenwich, all of R.I.

[73] Assignee: American Tourister, Inc., Warren, R.I.

[21] Appl. No.: 542,111

[22] Filed: Jun. 22, 1990

[51] Int. Cl.[5] ..... E05B 65/48

[52] U.S. Cl. ..... 70/73; 292/66; 292/113; 292/191; 292/192; 292/DIG. 31; 292/DIG. 42; 292/DIG. 49

[58] Field of Search ..... 70/73, 76, 83; 292/DIG. 49, DIG. 31, DIG. 42, 63, 64, 66, 113, 68, 191, 192, 250

[56] References Cited

U.S. PATENT DOCUMENTS

| | | | |
|---|---|---|---|
| 1,603,418 | 10/1926 | Scheider | 292/113 |
| 2,156,004 | 4/1939 | Vanderlinde | 292/DIG. 31 X |
| 2,242,385 | 5/1941 | Beyrodt | 292/192 X |
| 2,559,736 | 7/1951 | Scarborough | 292/254 |
| 2,710,214 | 6/1955 | Summers | 292/113 X |
| 2,798,371 | 7/1957 | Gehrie | 70/73 |
| 2,819,601 | 1/1958 | Atkinson | 70/73 |
| 2,921,810 | 1/1960 | Smith | 292/113 |
| 4,300,794 | 11/1981 | Dunsmoor | 292/DIG. 31 X |
| 4,365,831 | 12/1982 | Bourne | 292/DIG. 31 X |

FOREIGN PATENT DOCUMENTS

| | | | |
|---|---|---|---|
| 674923 | 11/1936 | Canada | 292/DIG. 49 |
| 514551 | 7/1955 | Canada | 292/DIG. 31 |
| 2114104 | 10/1972 | Fed. Rep. of Germany | 292/DIG. 49 |
| 165687 | 7/1921 | United Kingdom | 70/73 |
| 411621 | 6/1934 | United Kingdom | 70/73 |
| 775423 | 5/1957 | United Kingdom | 292/DIG. 31 |
| 2159870 | 12/1987 | United Kingdom | 292/113 |

*Primary Examiner*—Lloyd A. Gall

*Attorney, Agent, or Firm*—Wood, Herron & Evans

[57] ABSTRACT

A luggage latch secures a lid to a box. A hasp is mounted on the lid. A bolt and slide are mounted on the box with the bolt being resiliently mounted on the slide. When the lid is closed on the box, the bolt will resiliently snap into position to hold the lid on the box. The latch mechanism is recessed into the luggage so that its external surface is flush with the surface of the luggage.

7 Claims, 3 Drawing Sheets

25
12
26
28
17
20
57
54
16
15
58
27
19
50
61
21
53
60
18
51
45
80
81
52
49
44
46
47
31
48
35
32
82
68
42
65
40
69
41
33
66
67
83
34
84
75
74
73
72
30
76
11

12
17
20
26
15
27
61
50
60
57
53
58
51
21
16
25
54
18
46
19
52
80
81
31
45
40
34
47
82
42
75
43
44
67
49
66
48
84
69
41
68
35
65
83
33
32
74
72
73
30
11

LUGGAGE LATCH

BACKGROUND OF THE INVENTION

This invention relates to a luggage latch. More particularly, the invention relates to a luggage latch that lies flush with the surface of the luggage.

Hard-sided luggage is usually equipped with a pair of latches that project above the surface of the luggage. One common latch is called an elevated cam lock. A hasp projects upwardly from the lid and a faceplate is pivotally mounted on the box, the faceplate having on its undersurface a cam surface that engages the hasp and cams the hasp toward the box to draw the lid snugly against the box.

Another type of latch is the draw bolt latch that has been in use for many, many years. A hasp is mounted on the lid. A hook or bolt is mounted on an overcenter linkage on the box. To latch the lid, the hook is passed over the hasp and the bolt lever is snapped through its overcenter position to draw the hook and hasp toward the box to snugly close the lid against the box.

All of these types of latches require the lid to be held closed before any latching can be effected. Considering the fact that luggage is almost invariably overpacked, the user must press the lid onto the box to bring the hasp close enough to the box so that the latching can be accomplished. Then, while physically holding the lid on the box, the hasp is drawn toward the box by the manipulation of the latching mechanism.

BRIEF SUMMARY OF THE INVENTION

An objective of the present invention has been to provide a latch for hard-sided luggage which is aesthetically more appealing than the latches currently in use.

Another objective of the present invention has been to provide a latch mechanism that will preliminary latch the lid to the box simply by bringing the edge of the lid against the edge of the box. No manipulation of the latch is required.

Another objective of the present invention has been to provide a draw bolt mechanism that is concealed within the walls of the box and lid as contrasted to the conventional draw bolt, mechanism that requires all elements to be mounted in an exposed, protruding condition external to box and lid.

These objectives of the invention are attained by forming, for each latch, a recess in the box. The latch mechanism is disposed in the recess so that when latching is completed, the outer surface of the latching mechanism lies substantially flush with the surface of the luggage and does not project above it as has been the practice.

The objectives of the present invention have been further attained by providing a sliding bolt, and pivotal lever to actuate it, the bolt resiliently engaging a hasp on the lid of the luggage to ride over the latch and snap into a preliminary latched condition. This is accomplished simply by swinging the lid to a closed position and without any manipulation of the latch mechanism. Once the preliminary latching is effected, a swinging of the latch lever down to its flush position with respect to the luggage surface causes the bolt to draw the hasp toward the box and in so doing draw the edge of the lid snugly against the edge of the box.

The latch lever and bolt have three positions: a fully latched position wherein the lever lies flat on the box and the bolt pulls the hasp tightly toward the box; a fully opened position wherein the lever is swung upwardly through an arc of at least 90° thrusting the bolt to a position wherein it drops out of engagement with the hasp; and an intermediate position wherein the hasp can ride over and hook onto the bolt to hold the lid in a latched but not fully pulled against the box condition.

One further advantage of the present invention has been to facilitate the manufacture of luggage with a double band stainless steel frame. Conventional luggage, with an elevated cam lock, has a single stainless steel frame forming the edge of the box. The pivoting faceplate that effects the cam locking is mounted on the luggage so that it is substantially centered on the single steel frame when the luggage is closed and latched. The edge of the lid disappears into a groove in the single band on the box.

It is desired to use a double frame, one forming the edge of the lid, and one forming the edge of the box to add more strength to the lid. The double frame cannot use a conventional cam lock to latch the luggage since the double frame precludes the mounting of the faceplate in such a way that it centers itself on the double frame when the luggage is latched. The present invention is admirably suited to latching double frame luggage.

BRIEF DESCRIPTION OF THE DRAWINGS

The several features and objectives of the present invention will become more readily apparent from the following detailed description taken in conjunction with the accompanying drawings in which.

DETAILED DESCRIPTION OF THE INVENTION

Figure 1:
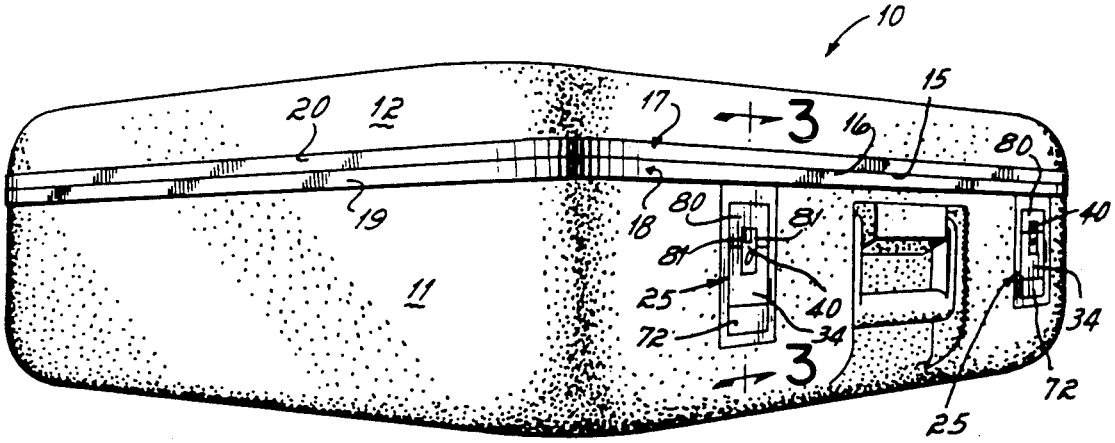
FIG. 1 is a perspective view of luggage employing the present invention.
Figure 2:
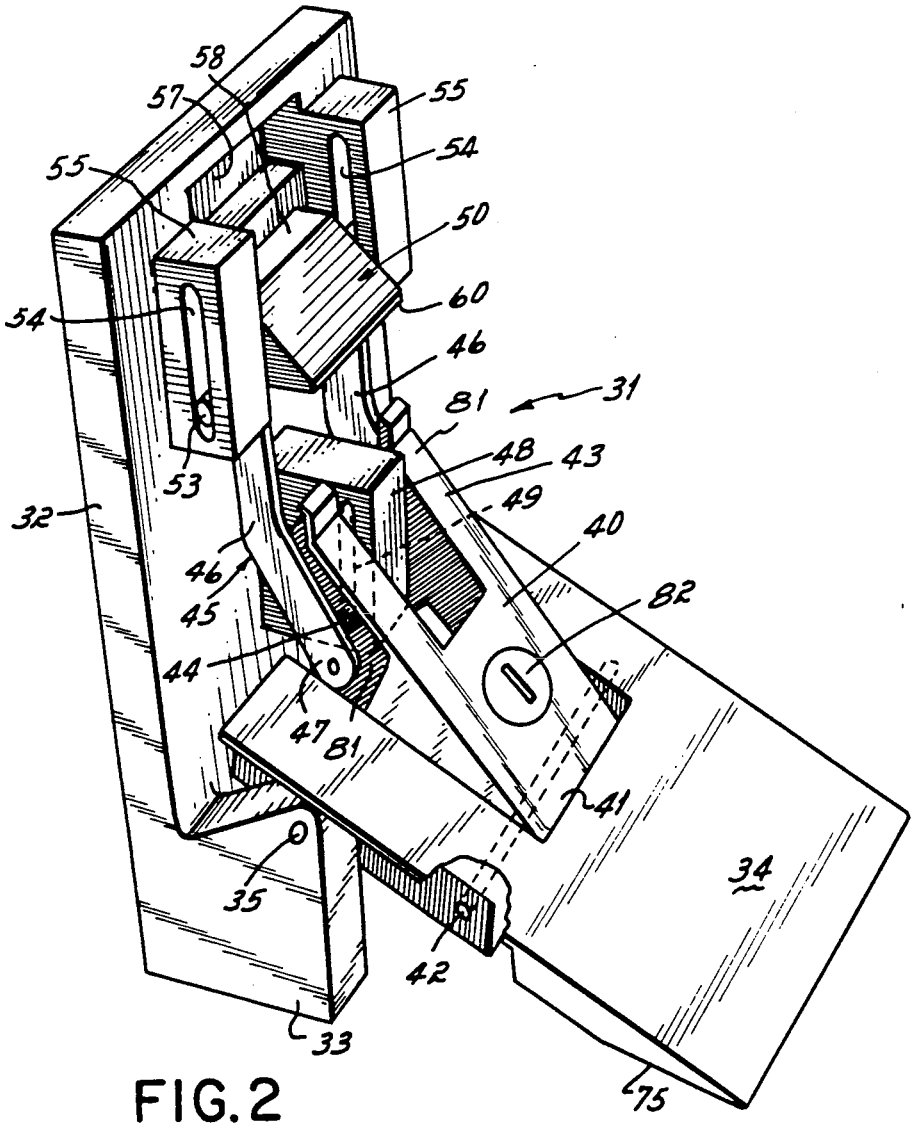
FIG. 2 is a perspective view of the latch of the present invention in open condition.
Figure 3:
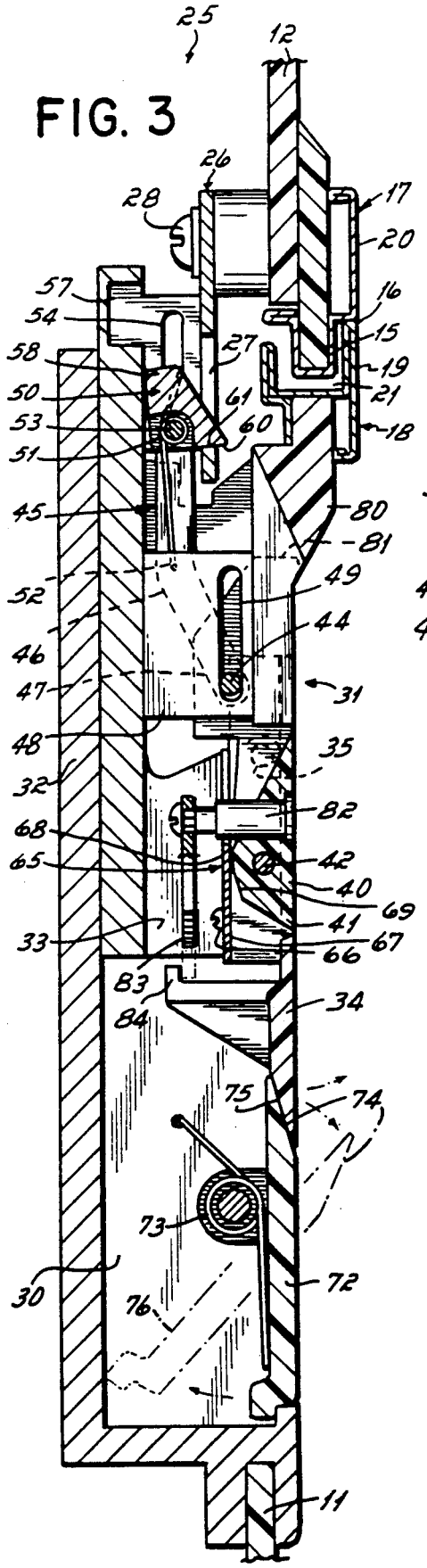
FIG. 3 is a cross-sectional view of the latch taken along line 3—3 of FIG. 1.

Referring to the drawings, luggage 10 has a box 11 and a lid 12 pivoted to the box. The lid has an edge 15 that normally mates with an edge 16 of the box. In the illustrated form of the invention, the luggage has a double band frame. Referring to FIG. 3, the edge of the lid is formed by a U-shaped stainless steel band 17, and the edge of the box is formed of an H-shaped stainless steel band 18. Each band has exposed about one-half inch of stainless steel when the lid is closed on the box, as indicated at 19 and 20 for the box and lid, respectively. The H-shaped stainless steel band has a groove 21 into which the edge 15 of the luggage seats when the lid is closed on the box.

The luggage has two flush-mounted latches 25. The latches are identical to each other and one of them will be described hereafter. The lid carries a hasp or keeper 26. The hasp has a hole 27 adapted to receive a bolt, as will be described. The hasp is secured to the inside surface of the lid 12 by a self-tapping screw 28.

The box has a recess 30 into which a latching mechanism 31 is mounted. The latching mechanism includes a plate or fixture 32 which is fixed in the recess 30. The plate 32 has a pair of laterally-spaced flanges 33 integral with the plate. A lever 34 is pivoted at 35 to the flanges 33.

A link 40 has one end 41 pivoted at 42 to the lever 34. The other end 43 of the link 40 is pivoted on a pin 44 to a slide 45 that is reciprocably/mounted on the plate 32. A central block 48 is formed integrally with the plate 32. The slide 45 is formed by two links 46 each having an upturned rear end 47 which is connected to the pin 44. The block has a longitudinal slot 49. The pivot pin 44 passes through the slot 49 and is guided by it.

A bolt 50 is pivotally mounted on the end of the slide 45. A spring 51 having an end 52 connected to the slide link 46 biases the bolt to rotate in a counterclockwise direction as viewed in the drawings. The bolt is mounted on a pin 53. The pin is slidable in a longitudinal slot 54 of each flange 55 mounted on the end of the plate 32 and straddling the slide. The plate 32 has a recess 57, which acts as a cam for the bolt 50, into which an end 58 of the bolt 50 can drop when the slide is thrust in its forwardmost direction toward the lid.

Figure 4:
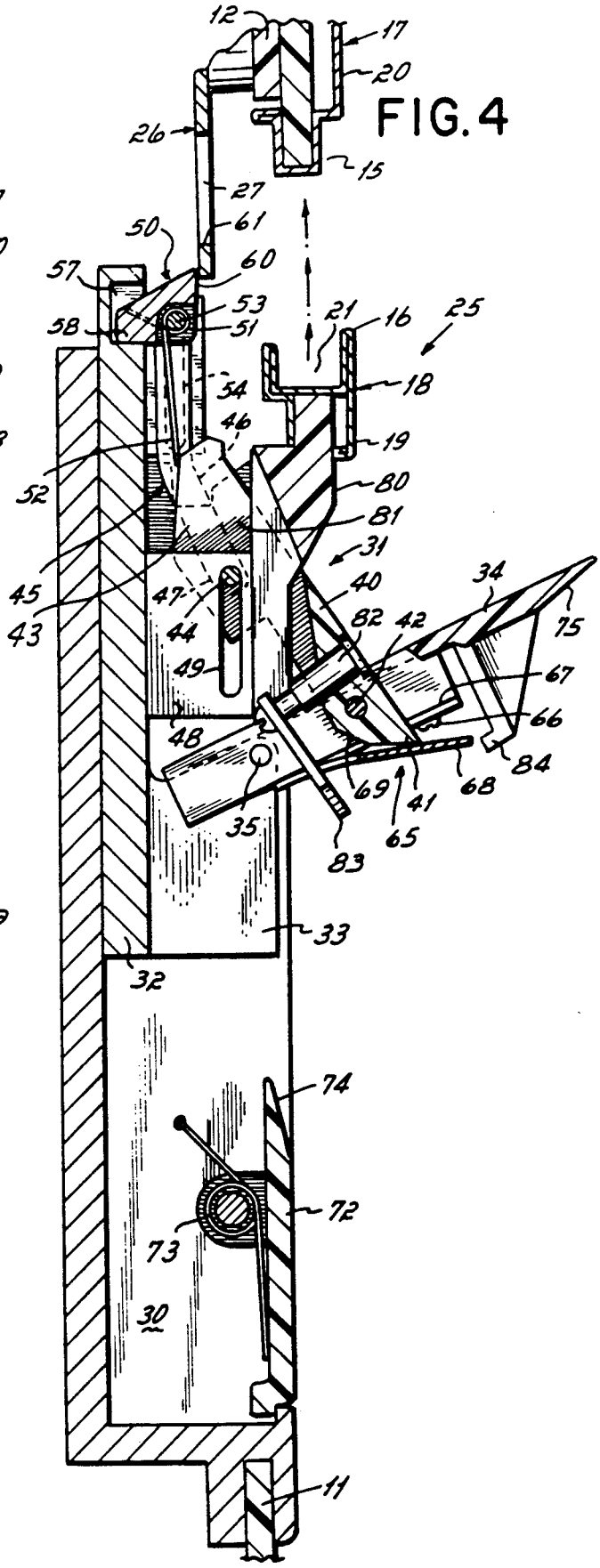
FIG. 4 is a cross-sectional view similar to FIG. 3 showing the latch in opened position.

The bolt has an upper edge 60 adapted to pass through the opening or hole 27 in the hasp 26. When the edge 60 passes through hole 27, it catches on a surface 61 of the hasp to hold the lid closed on the box as depicted in FIG. 3. When the slide is thrust in its forwardmost direction toward the lid and the bolt drops into the recess 57, the upper edge 60 of the bolt drops below the level of the hasp 26. This permits the hasp to slide past the bolt to permit the opening of the luggage as depicted in FIG. 4. As shown in FIG. 4, the lever has moved from a horizontal latched position of FIG. 3 through at least about 90° to about 110°. These positions, it should be understood, admit of considerable variation.

Figure 5:
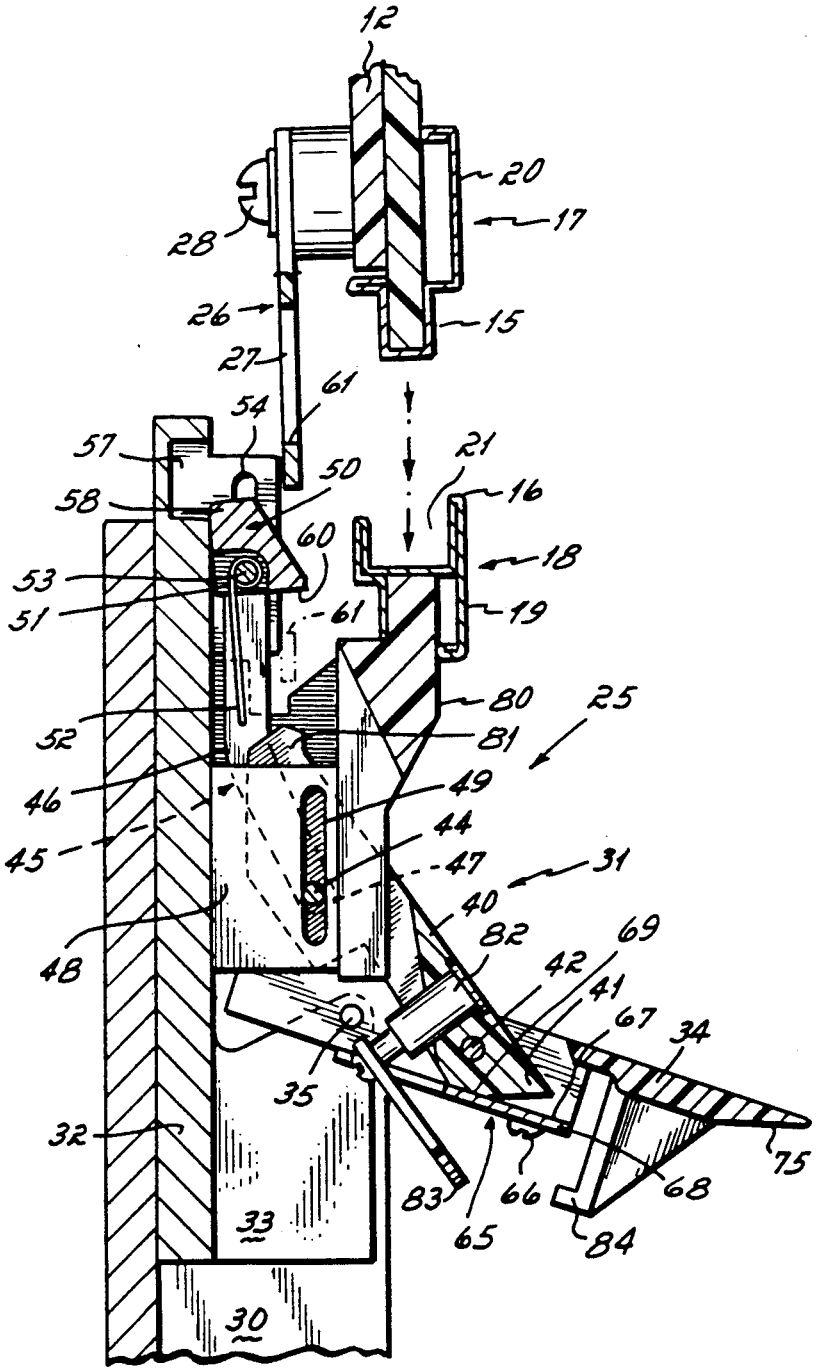
FIG. 5 is a cross-sectional view similar to FIG. 3 showing the latch in an intermediate position.

When the lever 34 is pivoted to an intermediate position as shown in FIG. 5, the end 58 of the bolt 50 rides out of the recess 57 and onto the surface of the plate 32. That action raises the edge 60 of the bolt above the level of the hasp. If the lid is closed upon the box when the bolt 50 and lever 34 are in the intermediate position, the hasp will contact the bolt, pivot it in a clockwise direction as viewed in FIG. 5 and ride over it. After the hasp passes the bolt, the bolt will return to its more or less upright position capturing the surface 61 of the hasp on the upper edge 60 of the bolt. The bolt is blocked from pivoting in a counterclockwise direction. Thus, the hasp and lid are held in a substantially closed position. Thereafter, if the lever 34 is pivoted to its flush position of FIG. 3, it draws the hasp and lid to a tightly-closed position with respect to the box.

The lever 34 has a spring steel plate 65 secured by screws 66 to its undersurface 67. The plate 65 has a central tongue 68 which is engageable by a surface 69 of the end 41 of link 40. The tongue 68 bearing against a surface 69 of the link 40 holds the lever 34 in an intermediate position depicted in FIG. 5. This provides assurance to the user that when the latch is in the intermediate position, it will stay there while the lid 12 is pushed against the box 11 to close the lid on the box.

When the lever 34 is swung from the intermediate position to the latched position of FIG. 3, the pivot axes 42 and 44 of the link 40 swing overcenter with respect to the axis 35 of the lever 34, thereby imparting a toggle action to the lever 34 and holding it in its horizontal latched position of FIG. 3.

The recess 30 preferably has a trap door 72 which is biased by a spring 73 to a horizontal flush position shown in the drawings. The door has a tapered surface 74 which is engageable with a cooperating tapered surface 75 on the lever 34. See FIG. 3. The trap door 72 can be depressed and pivoted into recess 34 as shown in the phantom lines 76. That action causes the surface 74 to flip the surface 75 on the end of the lever 34 in an upward position. In this position, a spring (not shown) may continue the opening motion of lever 34, or it can easily be grasped by the fingers of the user. The relationship of the trap door to the lever conceals the recess 30 and maintains the flush appearance of the latch elements. The trap door also keeps the rain or debris out of the recess adjacent the lever 34.

The plate 32 preferably has a configurated block 80 which conceals the latch mechanism. The block 80 has one slot that cooperates with two legs 81 on the link 40 to provide further concealment of the latch mechanism when the latch is in its closed flush position.

The link 40 carries a rotatable lock barrel 82 having a pivotal bolt 83. The lever 34 has a keeper 84 that projects under the bolt 83 when the lock is in a locked condition. The engagement of the keeper 84 with the bolt 83 prevents the lever from pivoting upwardly. To unlock the latch, the key is applied to the barrel 82, enabling it to swing the bolt 83 out of the path of the keeper 84.

The invention has been described in connection with a preferred structure in which the hasp has an opening which receives a bolt to latch the lid to the box. It should be understood that the hasp could be in the form of a hook and the bolt could be in the form of a slidable lever having a hole on the end, the lever being adapted to swing downwardly to disengage from the hasp and to swing upwardly to capture the hasp.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A luggage latch to join the edge of a box to the edge of a lid comprising:

a keeper fixed to the edge of said lid, a slide mounted on the edge of said box and movable toward and away from said keeper, a bolt pivotally mounted on said slide to pivot up into said keeper, a fixture mounted on said box, said slide being slidable on said fixture and having a raised end, lever and link means for moving said slide toward and away from said lid, said lever and link means comprising:

a link pivoted at one end to the raised end of said slide, a lever pivoted at one end to said fixture and centrally to the other end of said link, said link having pivot axes on said slide and lever moving through an overcenter position with respect to the pivot point of said lever on said fixture as said lever moves from a latch-open position to a latch-closed position, said slide being formed of two arms, said fixture having a central block alongside of which said arms move, said block having a longitudinal slot, said arms having a pivot pin that rides in said slot.

2. A luggage latch to secure a lid to a box comprising:
a hasp mounted on said lid,
a slide and bolt mounted on said box to permit said slide to move said bolt into and out of engagement with said hasp,
spring means normally urging said bolt to a position with respect to said hasp wherein said bolt can make a latching engagement with said hasp,
a link connected at one end to said slide, and
a lever pivoted to said box and connected to the other end of said link,
said lever having a horizontal position in which said slide is pulled to a tightly latching position,
said lever having an approximately vertical position in which said bolt is moved to a non-latching position,
said lever having an intermediate position wherein said bolt is projected toward said hasp and is in position to be engaged by said hasp whereby said hasp can move into latching engagement with said bolt to loosely latch said lid in closed position.

3. A luggage latch as in claim 2 further comprising:
a recess in said box in which said slide and bolt, and said link are disposed,
said lever having a free end lying over said recess when in said horizontal position,
a trap door mounted on a pivot axis to said box and normally overlying said recess,
said trap door having a free end on one side of said pivot axis underlying the free end of said lever to flip said lever having a free end up when a free end of said trap door on the other side of said pivot axis is depressed into said recess.

4. A luggage latch as in claim 2 further comprising:
a lock barrel mounted on said link,
a keeper mounted on said lever,
and a bolt mounted on said barrel and in operative position engageable with said keeper to block pivotal movement of said lever when said bolt is in operative position.

5. A luggage latch to secure a lid to a box comprising:
a hasp mounted on said lid,
a slide and bolt mounted on said box to permit said slide to move said bolt into and out of engagement with said hasp,
a link connected at one end to said slide,
a lever pivoted to said box and connected to the other end of said link,
said lever having a horizontal position in which said slide is pulled to a tightly latching position,
said lever having an approximately vertical position in which said bolt is moved to a non-latching position,
said lever having an intermediate position in which said hasp can move into latching engagement with said bolt to loosely latch said lid in closed position,
a spring plate mounted on said lever,
said link being engageable with said spring plate to hold said lever in intermediate position.

6. A luggage latch to secure a lid to a box comprising:
a hasp mounted on said lid,
a slide and bolt mounted on said box to permit said slide to move said bolt into and out of engagement with said hasp,
a link connected at one end to said slide,
a lever pivoted to said box and connected to the other end of said link,
said lever having a horizontal position in which said slide is pulled to a tightly latching position,
said lever having an approximately vertical position in which said bolt is moved to a non-latching position,
said lever having an intermediate position in which said hasp can move into latching engagement with aid bolt to loosely latch said lid in closed position, and
spring means operable on said lever to hold said lever in intermediate position.

7. A luggage latch to join the edge of a box to the edge of a lid comprising:
a keeper fixed to the edge of said lid,
a slide mounted on the edge of said box and movable toward and away from said keeper,
a bolt pivotally mounted on said slide to pivot up into said keeper,
a recess in said box adjacent said edge,
a fixture fixed in said recess,
said fixture having a horizontal plate with respect to which said slide moves, said plate having a recess into which said bolt drops to separate said bolt from said keeper,
flanges on said fixture, one on each side of said slide, said flanges having longitudinal slots,
said bolt having a transverse pivot pin whose ends project into said flange slots, said transverse pivot pin being slidable in said slots,
and lever and link means for moving said slide toward and away from said lid.

* * * * *

UNITED STATES PATENT AND TRADEMARK OFFICE

CERTIFICATE OF CORRECTION

PATENT NO. : 5,060,492

DATED : October 29, 1991

INVENTOR(S) : Lester E. Carpenter et al

It is certified that error appears in the above-identified patent and that said Letters Patent is hereby corrected as shown below:

Column 5, line 33, after "lever," delete -- having a free end --

Column 6, line 27, "aid" should be -- said -- .

Signed and Sealed this

Thirtieth Day of March, 1993

*Attest:*

STEPHEN G. KUNIN

*Attesting Officer*

*Acting Commissioner of Patents and Trademarks*